US005337577A

United States Patent [19]

Eiermann

[11] Patent Number: 5,337,577

[45] Date of Patent: Aug. 16, 1994

[54] METHOD AND APPARATUS FOR LATENT HEAT EXTRACTION

[76] Inventor: Kenneth L. Eiermann, 1049 Manchester Cir., Winter Park, Fla. 32792

[21] Appl. No.: 8,192

[22] Filed: Jan. 25, 1993

Related U.S. Application Data

[63] Continuation of Ser. No. 791,120, Nov. 12, 1991, Pat. No. 5,181,552.

[51] Int. Cl.[5] ..... F25B 29/00

[52] U.S. Cl. ..... 62/173; 62/176.5; 62/185

[58] Field of Search ..... 62/90, 173, 176, 5, 62/185, 99, DIG. 2; 165/21, 104.19

[56] References Cited

U.S. PATENT DOCUMENTS

| | | | |
|---|---|---|---|
| 1,837,798 | 12/1931 | Shipley | 62/90 X |
| 2,200,118 | 5/1940 | Miller | 62/90 X |
| 2,286,605 | 6/1942 | Crawford | 62/90 X |
| 2,291,029 | 7/1942 | Everetts, Jr. | 62/90 X |
| 2,438,120 | 3/1948 | Freygang | 62/173 |
| 2,715,320 | 8/1955 | Wright | 62/173 |
| 4,271,678 | 6/1981 | Liebert | 62/173 |
| 4,658,594 | 4/1987 | Langford | 62/176.5 |

FOREIGN PATENT DOCUMENTS 3415000 10/1985 Fed. Rep. of Germany ... 62/DIG. 2

*Primary Examiner*—William E. Wayner

*Attorney, Agent, or Firm*—Fay, Sharpe, Beall, Fagan, Minnich & McKee

[57] ABSTRACT

A method and apparatus for improved latent heat extraction combines a run-around coil system with a condenser heat recovery system to enhance the moisture removing capability of a conventional vapor compression air conditioning unit. The run-around coil system exchanges energy between the return and supply air flows of the air conditioning unit. Energy recovered in the condenser heat recovery system is selectively combined with the run-around system energy extracted from the return air flow to reheat the supply air stream for downstream humidity control. A control system regulates the relative proportions of the extracted return air flow energy and recovered heat energy delivered to the reheat coil for efficient control over moisture in the supply air flow. Auxiliary energy in the form of electric heat energy is further added to the recovered heat energy for additional reheat use.

63 Claims, 14 Drawing Sheets

SEA LEVEL PSYCHROMETRIC CHART

PROTRACTOR $$\frac{\text{SENSIBLE HEAT}}{\text{TOTAL HEAT}}$$

METHOD AND APPARATUS FOR LATENT HEAT EXTRACTION

This is a continuation application of application Ser. No. 07/791,120, filed Nov. 12, 1991, now U.S. Pat. No. 5,181,552.

BACKGROUND OF THE INVENTION

This application pertains to the art of air conditioning methods and apparatus. More particularly, this application pertains to methods and apparatus for efficient control of the moisture content of an air stream which has undergone a cooling process as by flowing through an air conditioning cooling coil or the like. The invention is specifically applicable to dehumidification of a supply air flow into the occupied space of commercial or residential structures. By means of selective combination of extracted return air flow heat energy and recovered refrigerant waste heat energy, the supply air flow is warmed using a reheat coil apparatus. The return air flow entering the air conditioning coil is precooled with a precooling coil in operative fluid communication with the reheat coil. Heating of the occupied space may be effected using the combined reheat and precooling coils in conjunction with an alternative heat source such as electric, solar, or the like and will be described with particular reference thereto. It will be appreciated, though, that the invention has other and broader applications such as cyclic heating applications wherein a supply air flow is heated at the reheat coil irrespective of the instantaneous operational mode of the refrigerant system through the expedient of a thermal energy storage tank or the like.

Conventional air conditioning systems use a vapor compression refrigeration cycle that operates to cool an indoor air stream through the action of heat transfer as the air stream comes in close contact with evaporator type or flooded coil type refrigerant-to-air heat exchangers or coils. Cooling is accomplished by a reduction of temperature as an air stream passes through the cooling coil. This process is commonly referred to as sensible heat removal. A corresponding simultaneous reduction in the moisture content of the air stream typically also occurs to some extent and is known as latent heat removal or more generally called dehumidification. Usually the cooling itself is controlled by means of a thermostat or other apparatus in the occupied space which respond to changes in dry bulb temperature. When controlled in this manner, dehumidification occurs as a secondary effect incidental to the cooling process itself. As such, dehumidification of the indoor air occurs only when there is a demand for reduced temperature as dictated by the thermostat.

To accomplish dehumidification when the thermostat does not indicate a need for cooling, a humidistat is often added to actuate the air conditioning unit in order to remove moisture from the cooled air stream as a "byproduct" function of the cooling. In this mode of operation, heat must be selectively added to the cooled air stream to prevent the conditioned space from overcooling below the dry bulb set point temperature. This practice is commonly known as "reheat".

Many sources of heat have been used for reheat purposes, such as hydronic hot water with various fuel sources, hydronic heat recovery sources, gas heat, hot gas or hot liquid refrigerant heat, and electric heat. Electric heat is most often used because it is usually the least expensive alternative overall. However, the use of electric heat to provide the reheat energy is proscribed by law in some states, including Florida for example.

In order to conserve energy, it has been suggested that recovered heat be used as a source for the reheat. Accordingly, one method to improve the moisture removal capacity of an air conditioning unit, while simultaneously providing reheat, is to provide two heat exchange surfaces each in one of the air streams entering or leaving the cooling coil while circulating a working fluid between the two heat exchangers. This type of simple system is commonly called a run-around system.

Run around systems have met with limited success. The working fluid is cooled in a first heat exchange surface placed in the supply air stream called a reheat coil. The cooled working fluid is then in turn caused to circulate through a second heat exchange surface placed in the return air stream called a precooling coil. This simple closed loop circuit comprises the typical run-around systems available heretofore.

The precooling coil serves to precool the return air flow prior to its entering the air conditioning cooling coil itself. The air conditioning coil then provides more of its cooling capacity for the removal of moisture from the air stream otherwise used for sensible cooling. However, the amount of reheat energy available in this process is approximately equal to the amount of precooling accomplished. This is a serious constraint. Additional reheat energy is often needed for injection into the run-around system to maintain the desired dry bulb set point temperature and humidity level in the conditioned space. As described above, supplemental electric reheat has been used with some success.

In addition, the growth of molds in low velocity air conditioning duct systems has recently become a major indoor air quality concern. One of the control measures recognized as having the capability of limiting this undesirable growth is the maintenance of the relative humidity at 70 percent or lower in the air conditioning system air plenums and ducts. Within limits, reheat can be used to precisely control the relative humidity. However, as described above, the amount of reheat energy from the run-around systems available today may not be sufficient to consistently provide the above level of humidity control, particularly during periods of operation when the air temperature entering the precooling coil is lower than the system design operating temperature.

As a further complication, air conditioning units are also often used for heating purposes as well as for cooling and dehumidification. Electric heating elements are often provided in the air conditioning units to selectively provide the desired amount of heat at precise times of the heating demand. The above demand for heating energy will most often correspond with the demand for heating at other air conditioning units in the locality. This places a substantial and noticeable demand on the electrical power utility system in the community. In many areas, this peak demand has exceeded the capacity of the power system. The electric utility companies have responded with incentives encouraging their customers to temper their demand during regional peak demand periods. These incentives are often in the form of demand charges which encourage the customer to reduce their demand on the system at those times in order to avoid incremental costs in addition to the regular base rates.

It has, therefore, been deemed desirable to provide an economical solution that meets the various needs of air conditioning system installation requirements while also operating in compliance with current and projected local environmental and energy-related laws.

SUMMARY OF THE INVENTION

This invention improves the dehumidification capabilities of conventional air conditioning systems through the addition of a run-around system having a supplemental heat energy source for reheat use. The amount of reheat energy that can be incrementally added to the stream of air leaving the conditioning unit is thereby increased. An air conditioning unit so configured is capable of operating continuously over a wide range of conditions for providing dehumidification to the occupied space independent of the sensible cooling demand at the conditioned space. Such a system is further capable of maintaining a precise relative humidity level in the air conditioning duct system to enhance the indoor air quality of the occupied conditioned space. Further, the overall system may be used to heat the occupied space through the expedient of the stored energy scheme according to the teachings of the preferred embodiments.

In the preferred embodiment, the supplemental heat source is heat recovered from the refrigeration process of the particular installed air conditioning system having the reheat requirement. In another embodiment, the supplemental heat is an alternative energy source, such as a gas or electric boiler, or water heater. The new energy source may be of particular benefit for use with an air conditioning system that uses chilled water or cold brine for the cooling medium.

The basic preferred embodiment of the invention comprises heat exchange coils in the entering air stream and leaving air stream of an air conditioning unit primary cooling coil. The basic preferred embodiment further comprises a circulating pump, and a supplementary heat source, which can be a heat recovery device on the air conditioning unit refrigeration circuit or a conventional liquid heater or the like.

DETAILED DESCRIPTION OF THE PREFERRED EMBODIMENTS

Figure 1:
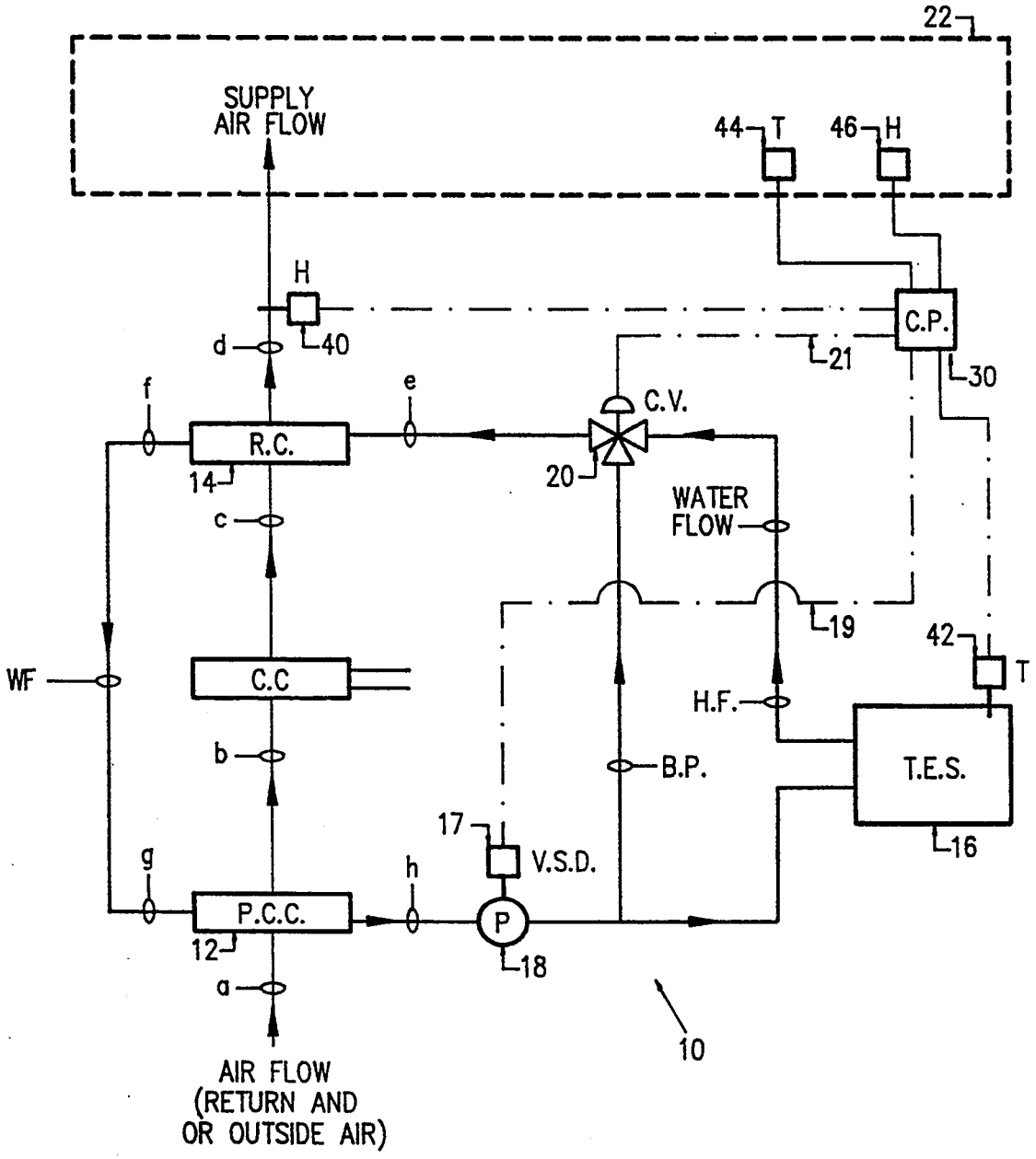
FIG. 1 illustrates a schematic view of the preferred embodiment of the apparatus for latent heat extraction according to the invention.

Referring now to the drawings wherein showings are for purposes of illustrating the preferred embodiments of the invention only and not for purposes of limiting same, the FIGURES show a moisture control apparatus 10 for conditioning the air in an occupied space 22. The apparatus 10 comprises suitably arranged components including a precooling coil 12 in a return air flow a,b, a reheat coil 14 in a supply air flow c,d, a thermal energy storage tank 16 operatively associated with a source of heat, a working fluid pump 18 for circulating a working fluid WF through a series arrangement of the above coils, a variable speed drive 17 for controlling the speed of pump 18 and a modulated control valve 20 for metering the working fluid. An apparatus controller 30 directly modulates the control valve 20 and generates variable speed command signals for control over the working fluid pump 18.

With particular reference to FIG. 1, the working fluid WF enters the control valve 20 from one of two sources including a bypass fluid flow BP and a heated fluid flow HF, the latter passing first through the thermal energy storage tank 16. In both above cases, the flow of the working fluid is motivated by the working fluid pump 18. A mixture of bypass fluid flow BP and heated fluid flow HF may be accomplished over a continuum by a blending control valve substituted for the modulated control valve 20, along with an analog output signal from the apparatus controller 30 described below.

The apparatus controller 30 is an operative communication with a plurality of system input devices, each of which sense various physical environmental conditions. These input devices include a supply airflow humidity sensor 40, a thermal energy storage tank temperature sensor 42, an occupied space dry bulb temperature sensor 44, and an occupied space humidity sensor 46. The humidity sensor 40 may be replaced with a temperature sensor for ease of maintenance and reliability.

In addition, the controller 30 is in operative communication with a plurality of active output devices. The output devices are responsive to signals deriving from the apparatus controller 30 according to programmed control procedures detailed below. In the preferred embodiment, the output devices comprise the control valve 20 responsive to a control valve signal 21, and a variable speed drive 17 responsive to a pump speed command signal 19. Additional input and output signals, including alarm and data logging signals or the like, may be added to the basic system illustrated in FIG. 1 as understood by one skilled in the art after reading and understanding the instant detailed description of the preferred embodiments.

Figure 2:
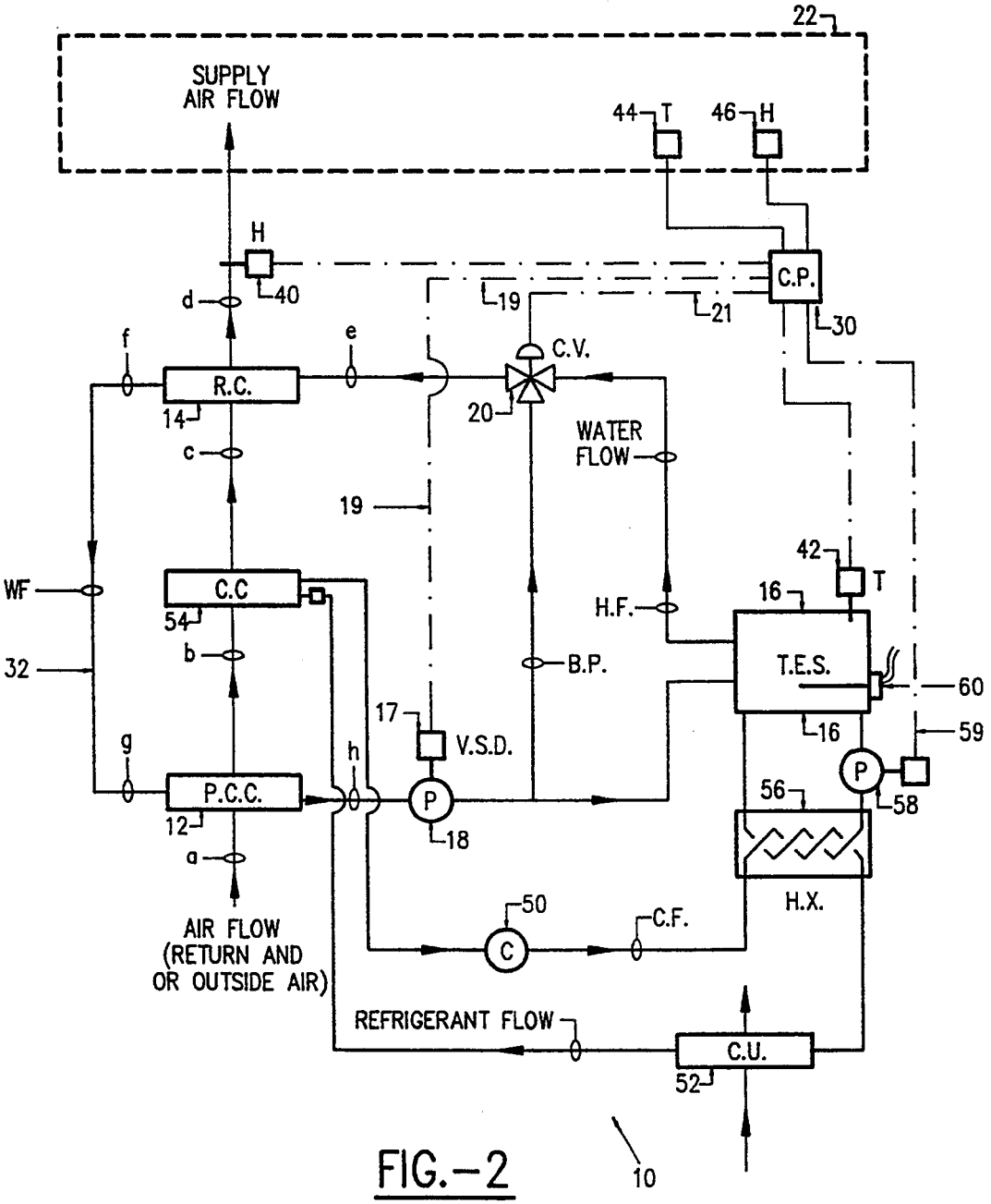
FIG. 2 illustrates a schematic view of the preferred embodiment of the invention when used with a conventional air conditioning unit having a vapor compression type refrigeration system.

With particular reference now to FIG. 2, a schematic diagram of the preferred embodiment of the apparatus of the invention is illustrated adapted for use with a conventional air-conditioning unit having a vapor compression type refrigeration system. The system includes a compressor 50 for compressing a compressible fluid CF and a condenser coil 52. An evaporative cooling coil 54 absorbs heat from a return air flow a, b resulting in a cooled supply air flow c, d into an occupied space 22. These various air conditioning components may be assembled in a single package, known in the art as a roof-top unit, or may be provided as a system comprising separated items, such as what is called a split system.

With continued reference to FIG. 2, a reheat coil 14, as described above, is placed in the supply air flow c, d after (downstream of) the evaporative cooling coil 54, while a precooling coil 12 is placed in the return air flow a, b before (upstream of) the cooling coil 54. For full effectiveness of the air quality control measure of the instant invention, the reheat coil 14 should be physically mounted as close as possible to the cooling coil 54. The precooling coil 12 can be mounted in any convenient location and may be so situated as to precool only the outside air, only the return air, or a mixture of the outside air and return air (not shown).

As above, the working fluid pump 18 is connected to a variable speed drive 17 which operates to circulate the working fluid WF between the reheat coil 14, the precooling coil 12, and the thermal energy storage tank 16. In the preferred embodiment, the working fluid is water. In general, the overall system may be used in various operating modes including a space cooling mode, a space dehumidification mode, and a space heating mode. To describe the full operation of the system, each of the operational modes will be described in detail below.

In the space cooling mode, the working fluid pump 18 operates when the refrigeration system compressor 50 is operating. In this mode, the compressor 50 is responsive to the occupied space dry bulb temperature sensor 44. The pump 18 is driven by the variable speed drive 17 which regulates the water flow to maintain the desired humidity setting at the supply air flow humidity sensor 40. Water flow is increased on a rise in the relative humidity above a predetermined set point and conversely decreased on a drop in relative humidity at the supply air flow humidity sensor 40 below said set point.

In the space dehumidification mode, the compressor 50 of the conventional air-conditioning unit is operated to maintain the humidity at the occupied space 22, as sensed by the occupied space humidity sensor 46, the speed of the working fluid pump 18 is regulated to maintain the desired temperature of the occupied space 22 as sensed by the occupied space dry bulb temperature sensor 44. In this dehumidification mode of operation, working fluid flow WF is increased on a drop in temperature at the occupied space dry bulb temperature sensor 44, and water flow is conversely decreased on a rise in the occupied space temperature responsive to command signals from the apparatus controller 30 and according to the control algorithms detailed below. When the temperature in the occupied space is a controlling factor in setting the working fluid pump speed, the supply air flow humidity set point is used to establish at a minimum working fluid pump speed. In any of the above modes, working fluid flow control may be accomplished using a two-port valve with a modulating actuator in place of the variable speed drive 17.

In general terms, cooled air leaving the evaporative type cooling coil 54 enters the reheat coil 14 where it absorbs heat from the working fluid flow in the tubes of the reheat coil itself. There is a drop in heat content of the working fluid from points e to f equal to the rise in the heat content of the air stream from points c to d. The working fluid is transferred through the piping system 32 to the precooling coil 12. Cooled working fluid from the reheat coil 14 absorbs heat from the return air flow stream as the air passes over the precooling coil surfaces. There is a rise in the heat content in the working fluid from points g to h equal to the drop in the heat content of the air stream from points a to b. These principles are each generally well-known and established in the art.

Heat exchange pump 58 operates when the compressor 50 is operating and when the temperature and the thermal energy storage tank 16 is below a predetermined set point at the thermal energy storage tank temperature sensor 42. The function of the heat exchange pump 58 is to transfer working fluid heated by the hot refrigerant gas in a heat exchanger 56. The heat exchange pump 58 stops even though the compressor 50 is running when the temperature in the thermal energy storage tank 16 is at an upper working fluid temperature set point as determined by the thermal energy storage tank temperature sensor 42. The general function of the heat exchanger 56 is to provide supplemental heat to charge the thermal energy storage tank 16 with hot working fluid for heating and/or reheat operation.

An electric heating element 60 may be used as an additional energy source to heat the working fluid when there is a demand for more heat than may be provided by the heat exchanger 56. The supplemental electric heating operation is controlled by the apparatus controller 30 to operate as a secondary source of energy when the temperature in the thermal energy storage tank 16 drops below the desired set point as determined by the thermal energy storage tank temperature sensor 42. As an example, if the desired minimum temperature in the thermal energy storage tank is 120° F. and the desired maximum temperature is 125° F., the heat exchange pump 58 is made to begin operation on a drop in temperature below 120° F. Conversely, when the thermal energy storage tank temperature drops to 120° F., the electric heating element 60 is activated by the apparatus controller 30. On a rise in the thermal energy storage tank temperature, the heating element 60 is first turned off, and on a continued rise in temperature to the 125° F. set point, the heat exchange pump 58 is next turned off. This scheme is hierarchically arranged in order to conserve energy by first recovering energy from the air-conditioning unit which might otherwise be lost.

Multiple heating elements similar to the electric heating element shown may be provided and controlled by a step controller to match the energy input to the heating load in stages of electric heat. An SCR controller may be used to proportionally control the amount of heat energy added to the thermal energy storage tank 16 as a function of the tank temperature differential from minimum to maximum set points. On a larger scale, such as neighborhood-wide, the electric heating controls may be circuited to allow the lock-out of the electric heating elements during periods of peak electrical demand throughout the neighborhood. This lock-out control may be in the form of an external signal, such as may be provided from the neighborhood power company, or from the owner's energy management system. The control may further be obtained from a signal from the system controls contained in the apparatus controller 30, as a function of the time of day, demand limiting, or other energy management strategies.

Figure 3:
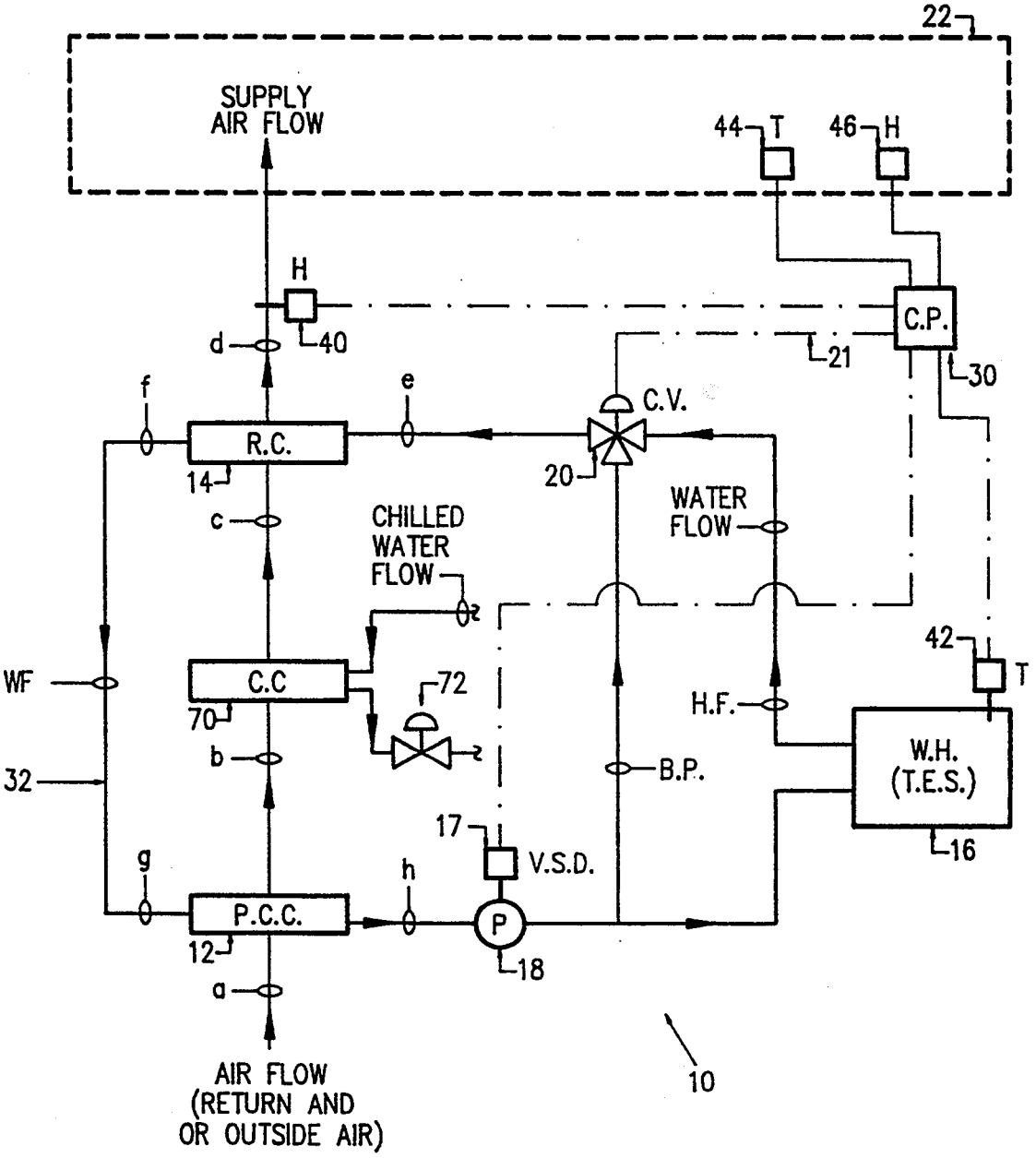
FIG. 3 illustrates a schematic of the preferred embodiment of the invention when used with an air conditioning unit using chilled water for the cooling medium.
Figure 4A:
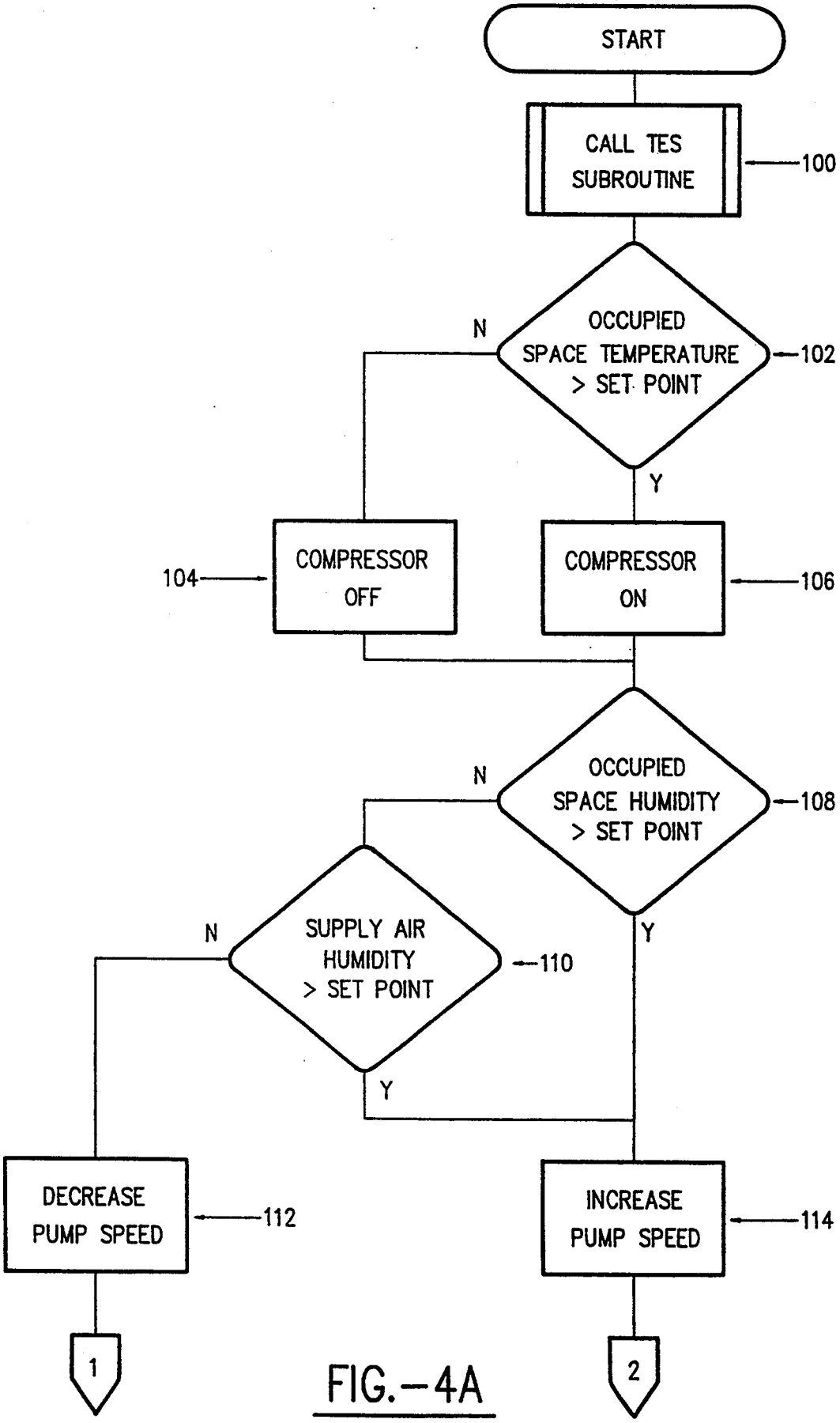
FIGS. 4*a*, 4*b* are flow charts of the control procedure executed by the control apparatus during the space cooling mode of operation.
Figure 4B:
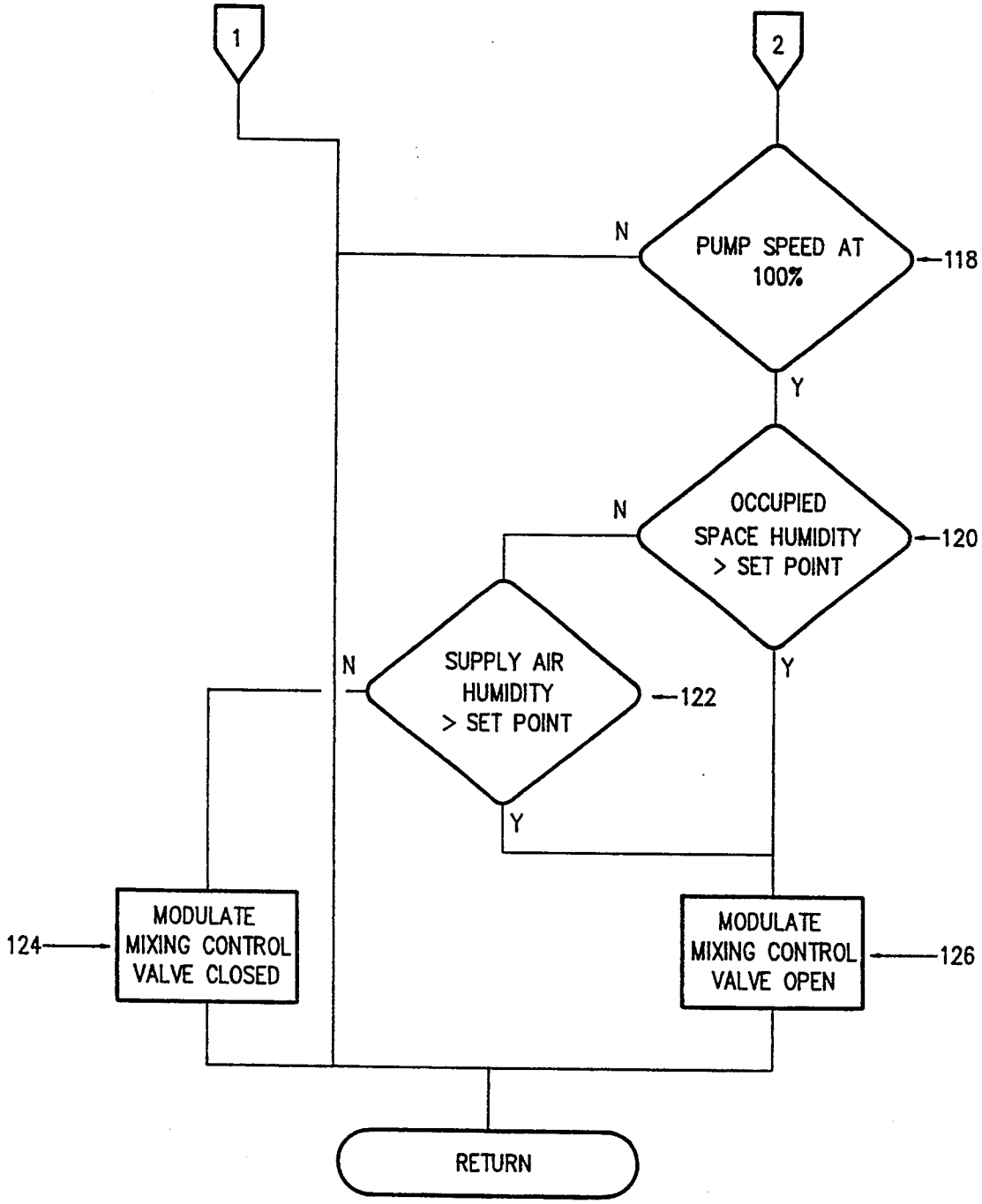
Figure 5A:
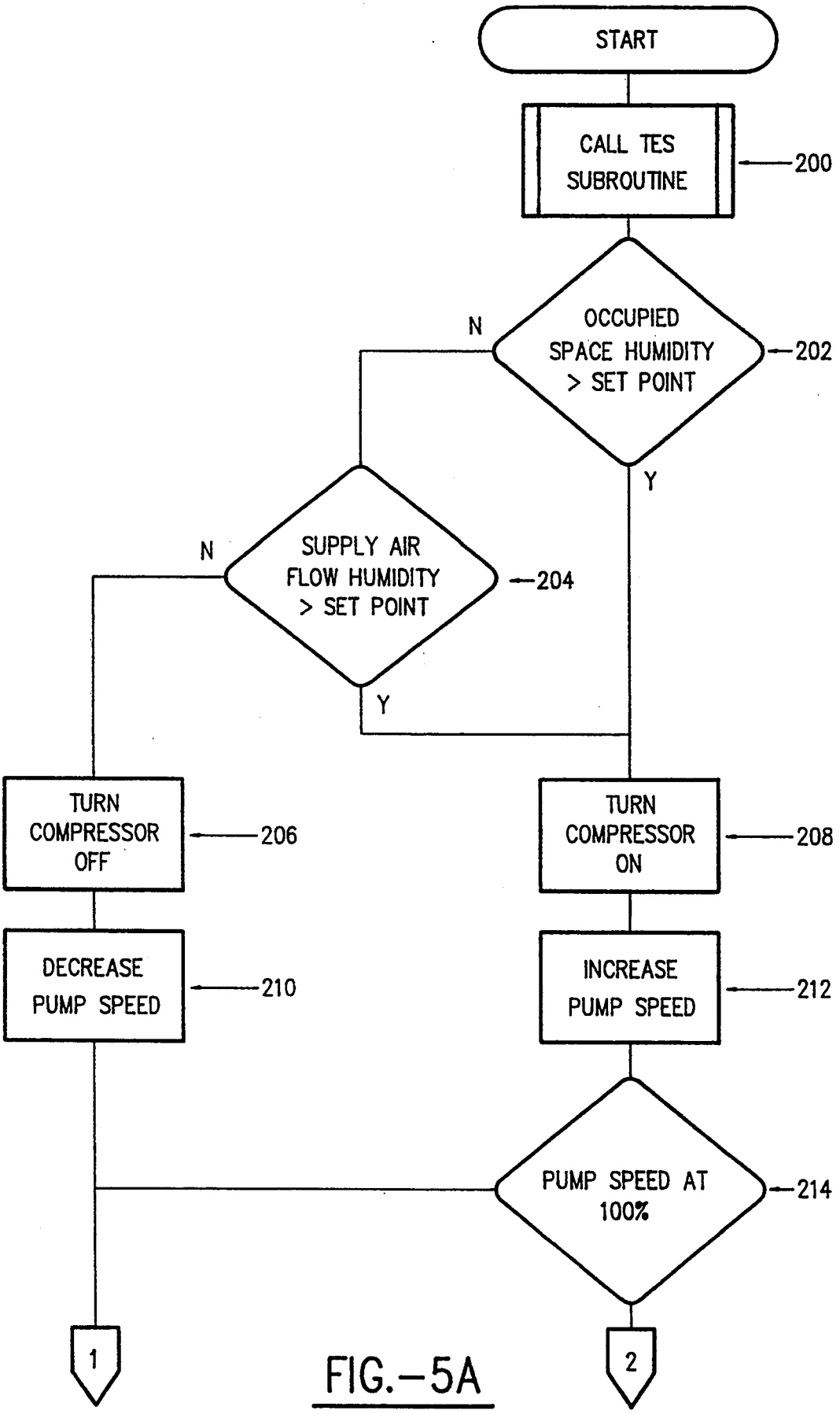
FIGS. 5*a*, 5*b* are flow charts of the control procedure executed by the control apparatus during the space dehumidification mode of operation.
Figure 5B:
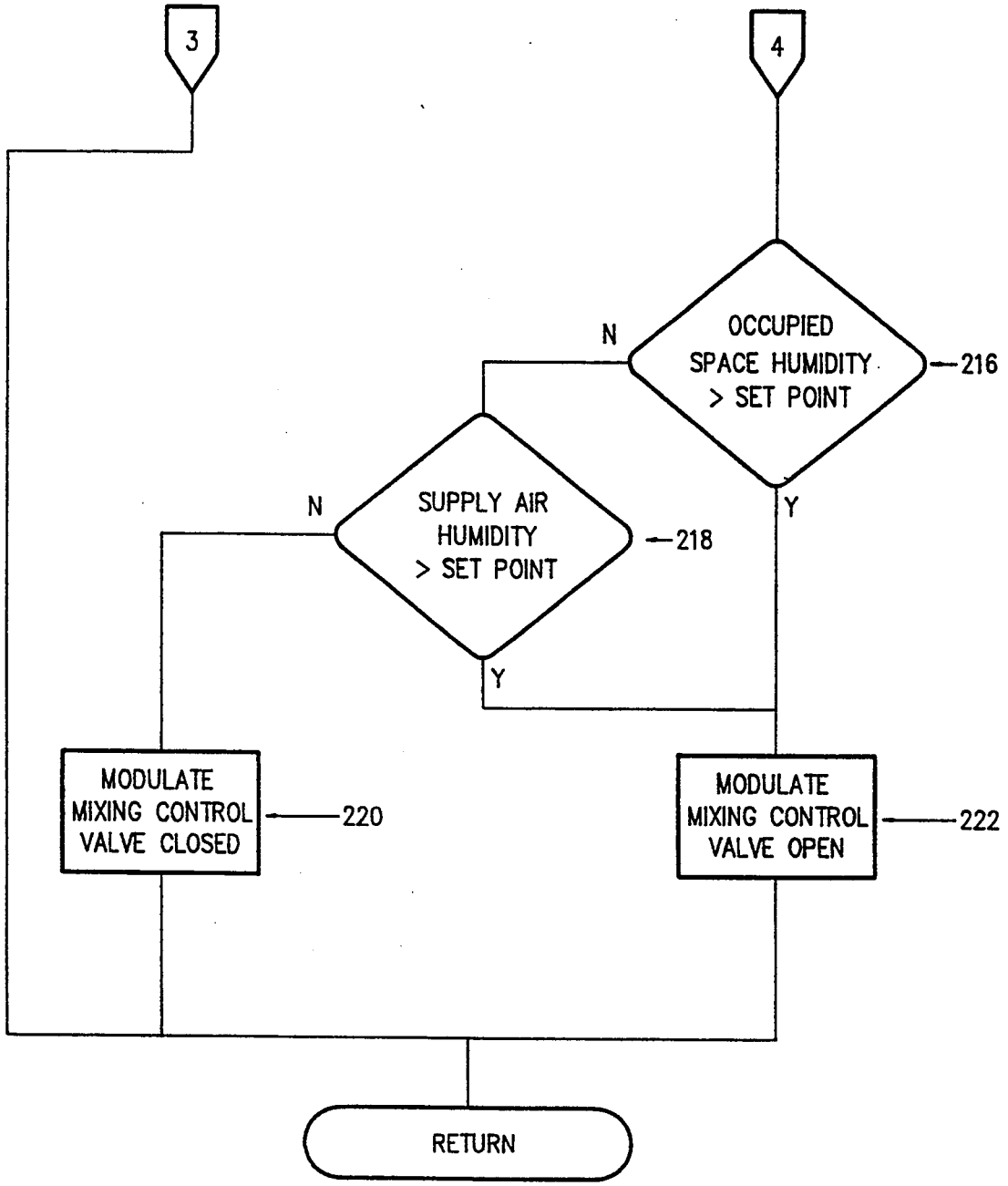

Referring next to FIG. 3, a schematic diagram of the preferred embodiment of the invention is illustrated and modified for use with an air-conditioning unit using chilled water as the cooling medium. The chilled water system uses a chilled water cooling coil 70 which may be mounted in a duct or plenum, or can be mounted in an air-handling unit with integral or remote mounted fans. Chilled water systems are usually provided with a control valve 72 to regulate the amount of cooling accomplished by the system in response to the occupied space dry bulb temperature sensor 44.

With continued reference to FIG. 3, a reheat coil 14, as described above, is placed in the supply air flow c,d after the evaporative cooling coil 54, while a precooling coil 12 is placed in the return air flow a,b before the cooling coil 54. For full effectiveness of the air quality control measure of the instant invention, the reheat coil 14 should be mounted as close as possible to the cooling coil 54. The precooling coil 12 can be mounted in any convenient location and may be so situated as to precool only the outside air, only the return air, or a mixture of the outside air and return air (not shown).

The pump 18 is connected to a variable speed drive 17 which operates to circulate the working fluid WF, in this preferred embodiment water, between the reheat coil 14, the precooling coil 12, and the thermal energy storage tank 16. In general, the overall system may be used in various operating modes including a space cooling mode, a space dehumidification mode, and a space heating mode. To describe the operation of the system, each of the operational modes will be introduced here and described in detail below.

In the space cooling mode, the working fluid pump 18 operates when there is a demand for cooling in space 22. In this mode, the control valve 72 is responsive to the occupied space dry bulb temperature sensor 44. The pump 18 is driven by the variable speed drive 17 which regulates the water flow to maintain the desired humidity setting at the supply air flow humidity sensor 40. Water flow is increased on a rise in the relative humidity above a predetermined set point and conversely decreased on a drop in relative humidity at the supply air flow humidity sensor 40 below said set point.

In the space dehumidification mode, the air-conditioning unit is operated to maintain the humidity at the occupied space 22, as sensed by the occupied space humidity sensor 46, the speed of the working fluid pump 18 is regulated to maintain the desired temperature of the occupied space 22 as sensed by the occupied space dry bulb temperature sensor 44. In this dehumidification mode of operation, working fluid flow WF is increased on a drop in temperature at the occupied space dry bulb temperature sensor 44, and water flow is conversely decreased on a rise in the occupied space temperature. Responsive to command signals from the apparatus controller 30 and according to the control algorithms detailed below. When the temperature in the occupied space is a controlling factor in setting the working fluid pump speed, the supply air flow humidity set point is used to establish at a minimum working fluid pump speed. In any of the above modes, working fluid flow control may be accomplished using a two-port valve with a modulating actuator in place of the variable speed drive 17.

In general terms, cooled air leaving the type cooling coil 70 enters the reheat coil 14 where it absorbs heat from the working fluid flow in the tubes of the reheat coil itself. There is a drop in heat content of the working fluid from points e to f equal to the rise in the heat content of the air stream from points c to d. The working fluid is transferred through the piping system 32 to the precooling coil 12. Cooled working fluid from the reheat coil 14 absorbs heat from the return air flow stream as it passes over the precooling coil surfaces. There is a rise in the heat content in the working fluid from points g to h equal to the drop in the heat content of the air stream from points a to b. These principles are each generally well-known and established in the air.

An electric heating element (not shown) may be used as a supplemental energy source to heat the working fluid when there is a demand for additional heat. The supplemental electric heating operation is controlled by the apparatus controller 30 to operate as a secondary source of energy when the temperature in the thermal energy storage tank 16 drops below the desired set point as determined by the thermal energy storage tank temperature sensor 42. As an example, if the desired minimum temperature in the thermal energy storage tank is 120° F. and the desired maximum temperature is 125° F., the electric heating element (not shown) is activated by the apparatus controller 30 when the thermal energy storage tank temperature drops to 120° F. On a return in the thermal energy storage tank temperature to 125° F., power to the heating element is turned off.

Multiple heating elements similar to the electric heating element described above may be provided and controlled by a step controller to match the energy input to the heating load in stages of electric heat. An SCR controller may be used to proportionally control the amount of heat energy added to the thermal energy storage tank 16 as a function of the tank temperature differential from minimum to maximum set points. On a larger scale, such as neighborhood-wide, the electric heating controls may be circuited to allow the lock-out of the electric heating elements during periods of peak electrical demand throughout the neighborhood. This lock-out control may be in the form of an external signal, such as may be provided from the neighborhood power company, or from the owner's energy management system. The control may further be obtained from a signal from the system controls contained in the apparatus controller 30, as a function of the time of day, demand limiting, or other energy management strategies.

With reference now to FIGS. 2, 3, 4*a* and 4*b*, the control method for the space cooling mode operation will be described. In the space cooling mode, the compressor 50 of FIG. 2 and the chilled water cooling coil 70 of FIG. 3 are operated 104, 106 to maintain the desired set point dry bulb temperature in the occupied space 22 according to the occupied space dry bulb temperature sensor 44. In the conventional air-conditioning system, the compressor 50 starts 106 on a rise in occupied space temperature above a predetermined set point and stops 104 on a fall in occupied space temperature below the set point temperature 102 as sensed by the occupied spaced dry bulb temperature sensor 44. Correspondingly, in the chilled water system, the control valve 20 opens 106 on a rise in the occupied space temperature and closes 104 on a fall in the occupied space temperature below the predetermined set point at occupied space dry bulb temperature sensor 44. In either case, the speed of the working fluid pump 18 is regulated by the variable speed drive 17 to maintain the desired relative humidity 110 in the supply air flow d as sensed by the supply air flow humidity sensor 40.

The pump speed is also controlled to maintain the desired relative humidity 108 in the occupied space 22 according to the occupied space humidity sensor 46. The working fluid pump speed increases 114 on a rise in the relative humidity above the supply air or the occupied space air relative humidity set points. The working fluid pump speed decreases 112 on a fall in the relative humidity below the set points.

When the variable speed drive 17 is at full speed 118, the control valve 20 is modulated to maintain the desired humidity set points 120, 122. The control valve 20 is positioned to bypass the thermal energy storage tank 16 when the working fluid pump 18 is operating at speeds of less than 100% of full speed. When the variable speed pump 18 is at full speed, the control valve 20 is modulated open 126 to thermal energy storage tank 16 on a rise in supply air 122 or occupied space 120 relative humidity above the predetermined set points according to the supply air flow humidity sensor 40 and the occupied space humidity sensor 46 respectively. In this state, the working fluid flows to the reheat coil 14 directly from the thermal energy storage tank 16 as a heated working fluid flow HF. The control valve 20 is modulated closed 124 on a decrease in the supply air or occupied space air relative humidity below the predetermined set points.

Next, with reference to FIGS. 2, 3, 5*a* and 5*b*, the control method for the space dehumidification operating mode will now be described. During this mode, when the occupied space dry bulb temperature set point is satisfied according to the occupied space dry bulb temperature sensor 44, the compressor 50 of the conventional air conditioning unit is operated to maintain the desired occupied space relative humidity. In the chilled water system, the chilled water control valve 72 is operated to maintain the desired occupied space relative humidity. In this mode, the compressor 50 or the chilled water control valve 72 operate 208 on a rise in the occupied space relative humidity 202 above the set point and stop 206 on a drop in the occupied space relative humidity 202 below said set point. The working fluid pump 18 and control valve 20 are controlled 210–222 according to the space cooling mode described above.

Figure 6:
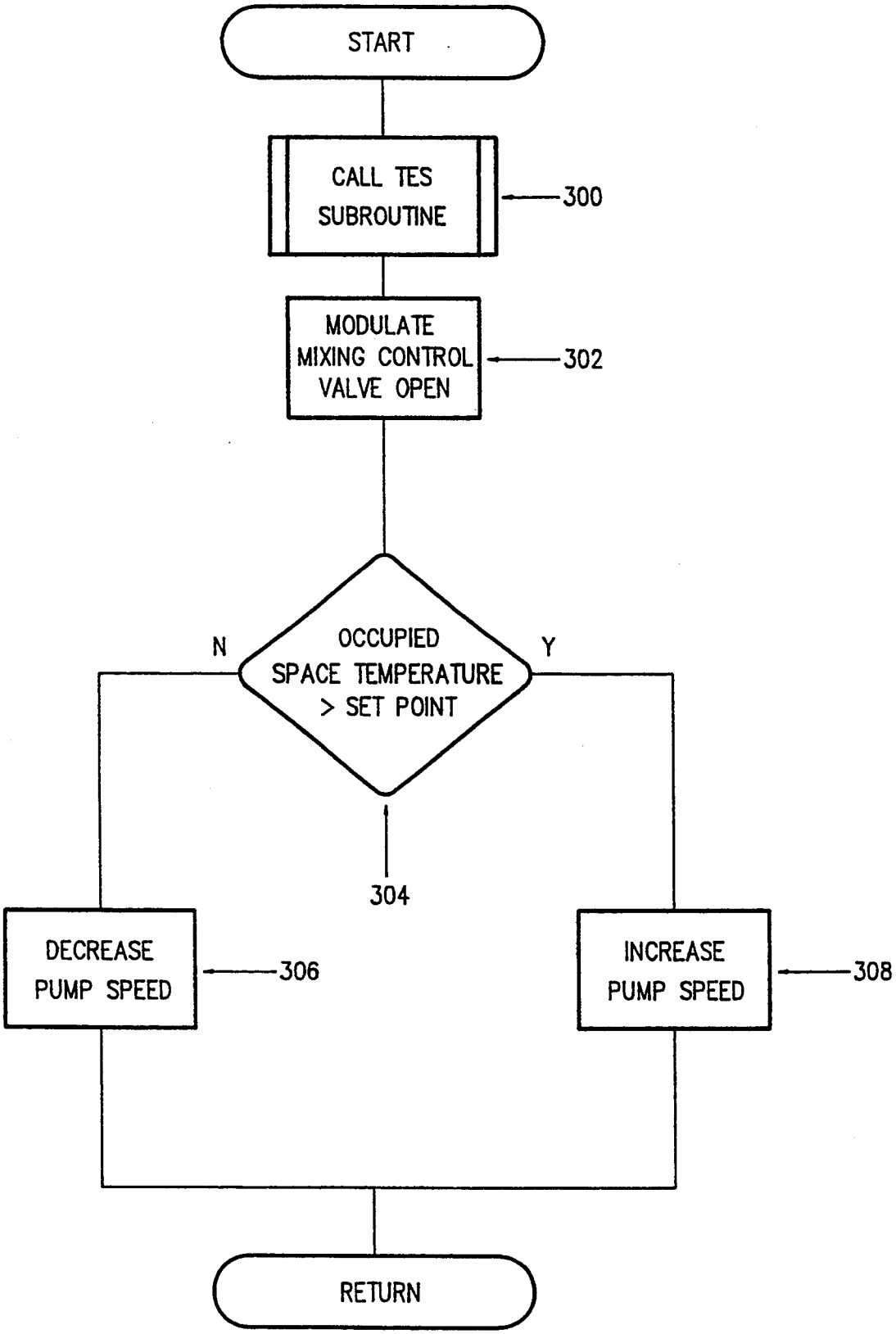
FIG. 6 is a flow chart of the control procedure executed by the control apparatus during the space heating mode of operation.

With reference next to FIGS. 2, 3 and 6, the control method for the space heating operating mode will now be described. In this mode, the thermal energy storage tank 16 is utilized to maintain the desired occupied space dry bulb temperature according to the physical conditions sensed by the occupied space humidity sensor 46. Normally in this mode, the compressor 50 and chilled water control valve 72 are both off in the standard air-conditioning system and chilled water systems respectively. In the instant space heating mode, the working fluid WF is circulated exclusively through the thermal energy storage tank 16 as a heated fluid flow HF. No flow is permitted through the bypass as a bypass fluid flow BP. This is accomplished via the control valve 20 modulated open 302 according to the control valve signal 21 from the apparatus controller 30. The speed of the working fluid pump 18 is adjusted 306, 308 to maintain the desired temperature set point 304 in the occupied space 22. As an alternative means, the working fluid pump 18 may be continuously operated, but cycled on and off according to the demand for heating as sensed by the occupied space dry bulb temperature sensor 44. This results in an average heating defined by the duty cycle of the alternating on/off cycles.

Figure 7:
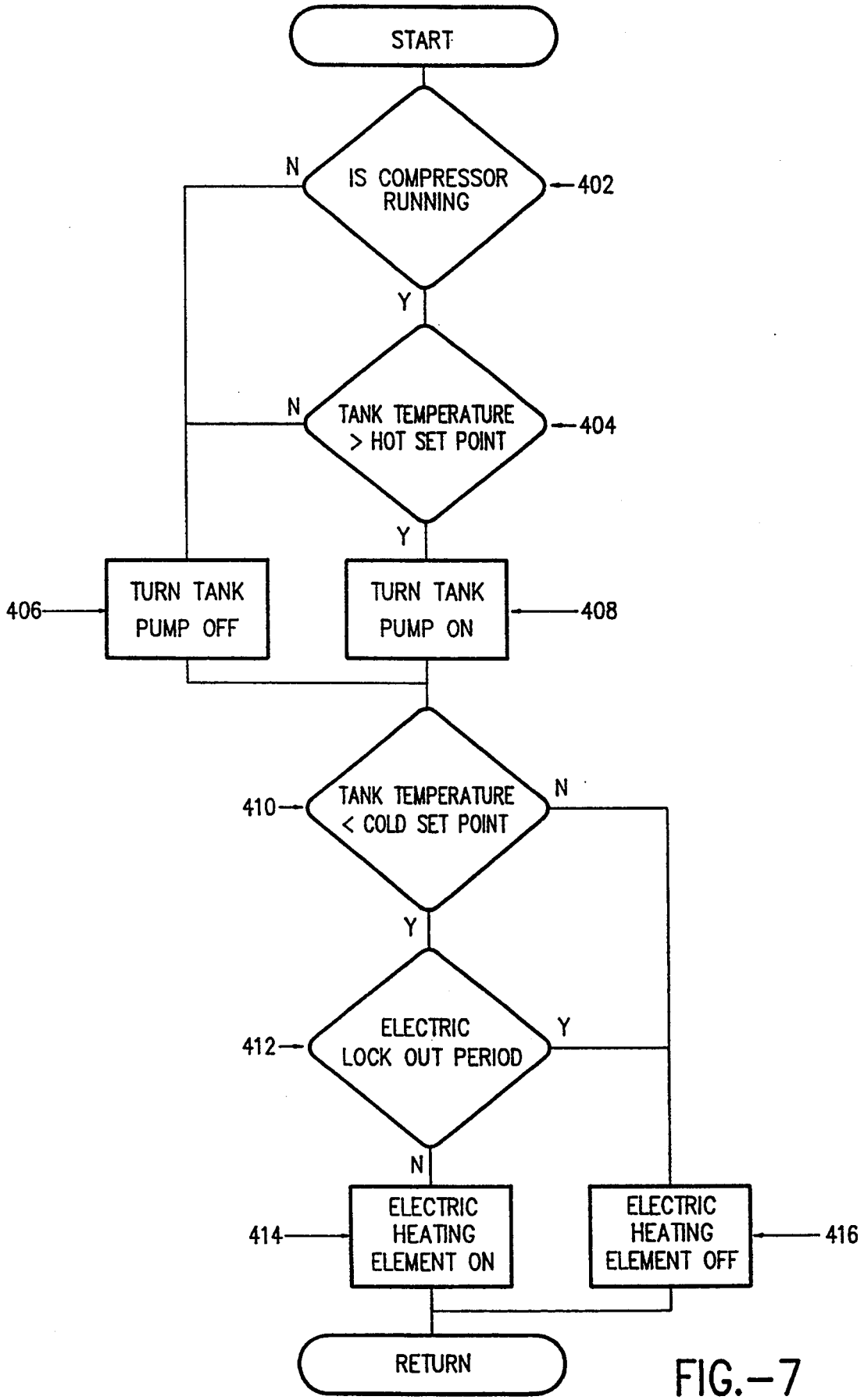
FIG. 7 is a flow chart of the control procedure executed by the control apparatus during the various operational modes for maintenance of the thermal energy storage tank temperature.

With reference now to FIG. 7, the thermal energy storage tank maintenance routine TES will be now described in detail. The method is a subroutine in each of the space cooling, space dehumidification, and space heating control methods described above. In this control subroutine procedure, heat exchange pump 58 operates 408 when the compressor 50 is operating 402 and when the temperature in the thermal energy storage tank 16 is below the set point 404 at temperature sensor 42. The function of pump 58 is to transfer water WF heated by the hot refrigerant gas in the heat exchanger 56. The pump stops 406 when the temperature in the tank is at the upper water temperature set point 404 at the temperature sensor 42. The function of the heat exchanger is to provide supplemental heat to charge the thermal storage tank 16 with hot water for heating and/or reheat operation.

Electric heating element 60 may be used as an additional energy source to heat the water when there is a demand for more heat than can be provided by the heat exchanger. The electric heating operation is controlled by the apparatus controller 30 to operate 414 as the second source of energy when the temperature in the thermal storage tank 16 drops below the desired set point 410 at sensor 42. As an example, if the desired minimum temperature in the tank is 120° F. and the desired maximum temperature is 125° F., the pump 58 starts on a drop in temperature below 125° F. When the tank temperature drops to 120° F., the electric heating element 60 is activated. On a rise in tank temperature the heating elements are turned off first 416, and on a continued rise in temperature to 125° F. the pump 58 is, in turn, shut off 406. Multiple heating elements may be provided and controlled by a step controller to match the energy input to the heating load in stages of electric heat or an SCR controller can be used to proportionately control the amount of heat energy added to the tank as a function of the tank temperature differential from minimum to maximum set points.

The electric heating controls may further be circuited to allow for a lock out 416 of the electric heating elements during periods of peak community electrical demand 412. This lock out control could be provided from an external signal such from the power company or from the owner's energy management system. The control could be from a signal from the system controls contained in control 30 as a function of time of day, demand limiting, or other energy management strategies.

With reference once again to FIG. 2, the system may be operated in a variety of modes. In general, when the overall system is operating in either the cooling mode or the dehumidifying mode the cold air leaving the evaporator coil 50 enters the reheat coil 14 where it absorbs heat from the moving water stream WF in the tubes of the reheat coil 12. There is a corresponding drop in the heat content of the circulating water from points e to f equal to the rise in heat content of the air stream from points c to d. The water WF is transferred through a piping conduit system to the precooling coil. Cold water entering the precooling coil 12 absorbs heat from the return air stream a as it passes over the coil surfaces. There is a rise in heat content of the circulating water from points g to h equal to the drop in heat content of the air stream from points a to b. Representative sample calculations follow below.

SAMPLE CALCULATIONS

Figure 8:
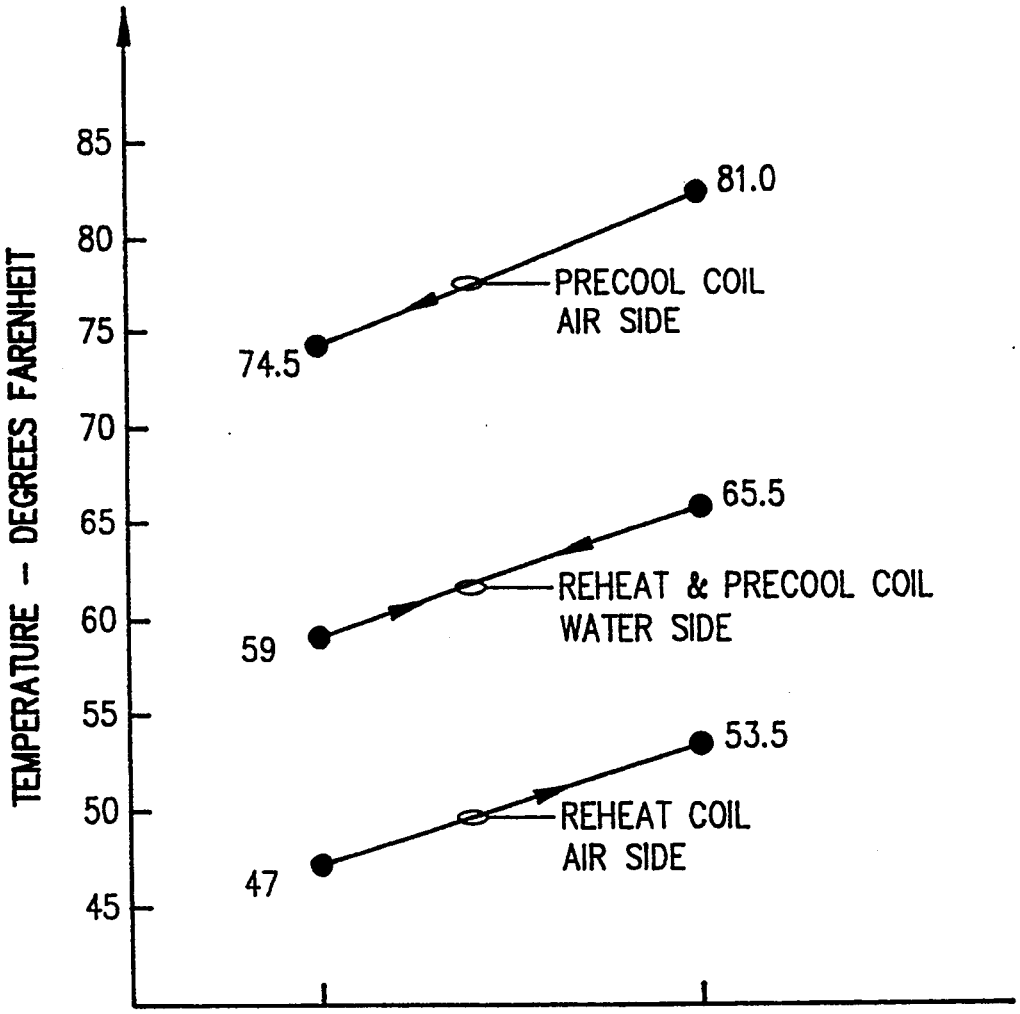
FIG. 8 is a coil graph of a first sample calculation.
Figure 11A:
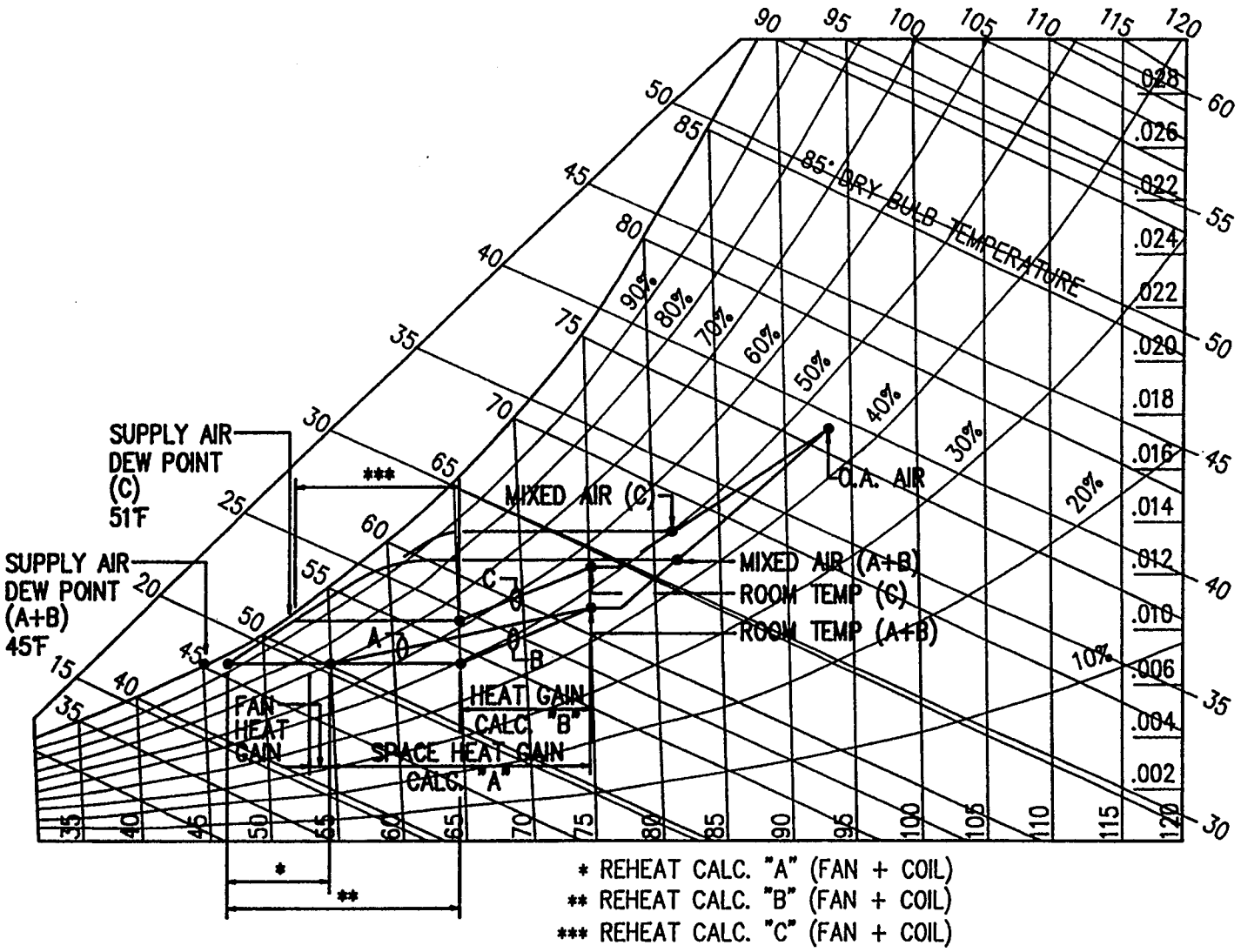
FIG. 11*a*, 11*b* are a psychometric chart of the combined first, second and third sample calculations and a protractor for use with the psychometric chart.
Figure 11B:
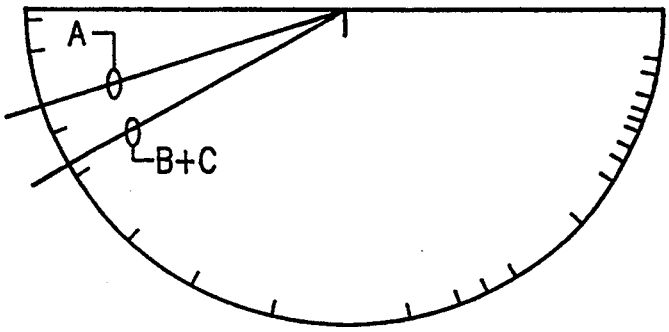

The sample calculation A immediately below is illustrated in the coil graph of FIG. 8 and in the psychometric chart of FIGS. 11*a*, 11*b* wherein it is Given that:

Required indoor temperature is 75° F. at 45% relative humidity;
Indoor cooling load (peak load) is

| | |
|---|---|
| 220.0 | MBTU/Hour Sensible |
| 94.3 | MBTU/Hour Latent |
| 314.3 | MBTU/Hour Total; |

Outdoor air temperature at peak cooling load is 93° F. dry bulb and 76° dry wet bulb;
Amount of ventilation air (outside air) required is 2500 CFM;
Desired supply air relative humidity level is 70% maximum;
Return air heat gain assumed equal to a 2° F. ΔT rise; and
Fan and motor heat gain assumed equal to a 1½° F. ΔT rise.

Statement of Solution:

$$\text{Sensible heat ratio} = \frac{220.0}{314.3} = 0.70$$

Room condition line intersects 70% RH line at 55° F.
Supply air volume required:

$$V = \frac{220000\ \text{BTU/HR}}{1.1 \cdot 20°\ \Delta T}$$

Reheat energy required to provide 70% Rel. Hum. in supply air stream:

$$Q = 10000\ \text{CFM} \cdot 1.1 \cdot [(55 - 47)\ °\text{F.}\ \Delta T - 1\tfrac{1}{2}\ °\text{F.})]$$
$$= 71500\ \text{BTU/HR}$$

Water flow rate required through reheat coil assuming 6½° F. ΔT and 12° F. approach temperature:
V = 71500 BTU/Hour/ (500 · 6.5° F. ΔT) = 22 GPM Coil conditions - Temperature:

| | Air | Water |
|---|---|---|
| Entering Coil | 47 | 65.5 |
| Leaving Coil | 53.5 | 59.0 |

Precooling coil air temperature drop (sensible cooling):

$$\Delta T = \frac{Q}{1.1 \cdot \text{CFM}}$$

Q = Amount of energy recovered for supply air stream at reheat coil
ΔT = 71500 BTU/Hour/1.1 · 10000 CFM = 6.5° F. ΔT Coil conditions - Temperature

| | Air | Water |
|---|---|---|
| Entering Coil | 81 | 59 |
| Leaving Coil | 74.5 | 65.5 |

Figure 9:
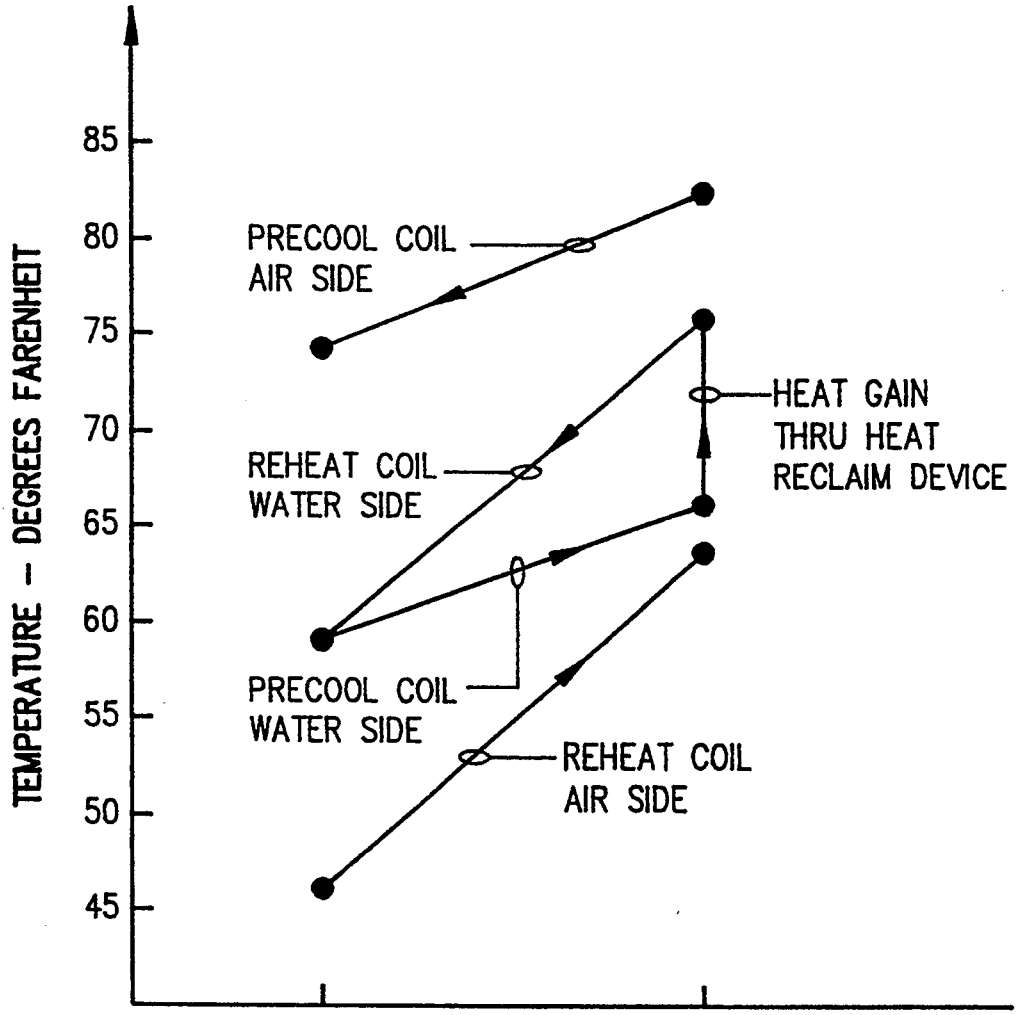
FIG. 9 is a coil graph of a second sample calculation.

The sample calculation B immediately below is illustrated in the coil graph of FIG. 9 and in the psychometric chart of FIGS. 11*a*, 11*b* wherein it is Given that:

Same condition as calculation (A), except indoor sensible cooling load is 110.0 MBTU/Hour; and,
Assume supply air dew point is fixed at 45° F. due to coil characteristics;

Statement of Solution:

New sensible heat ratio $$\frac{110.0}{110 + 94.3} = 0.54$$

-continued

Reheat energy required $$Q = 10000\ \text{CFM} \cdot 1.1 \cdot [(65 - 47)\ °\text{F.}\ \Delta T - 1\tfrac{1}{2}\ °\text{F.})]$$
$$= 181500\ \text{BTU/hour}$$

Water temperature required using 22 GPM flow rate $$\Delta T = \frac{181500\ \text{BTU/hour}}{22\ \text{GPM} \cdot 500} = 16.5°\ \Delta T\ °\text{F.}$$

Reheat energy required from refrigerant heat recovery:
$Q_3 = Q_1 - Q_2$
$Q_1$ = Total reheat required
$Q_2$ = Water heat gain in precooling coil (from Calculation (A))
$Q_3$ = 181500 − 71500 BTU/hour = 110,000 BTU/hour
Temperature rise required by water through heat reclaim device:

$$\Delta T = \frac{Q_3}{500} \cdot 22\ \text{GPM} = \frac{110000}{500} \cdot 22\ \text{GPM} = 10°\ \text{F.}$$

Figure 10:
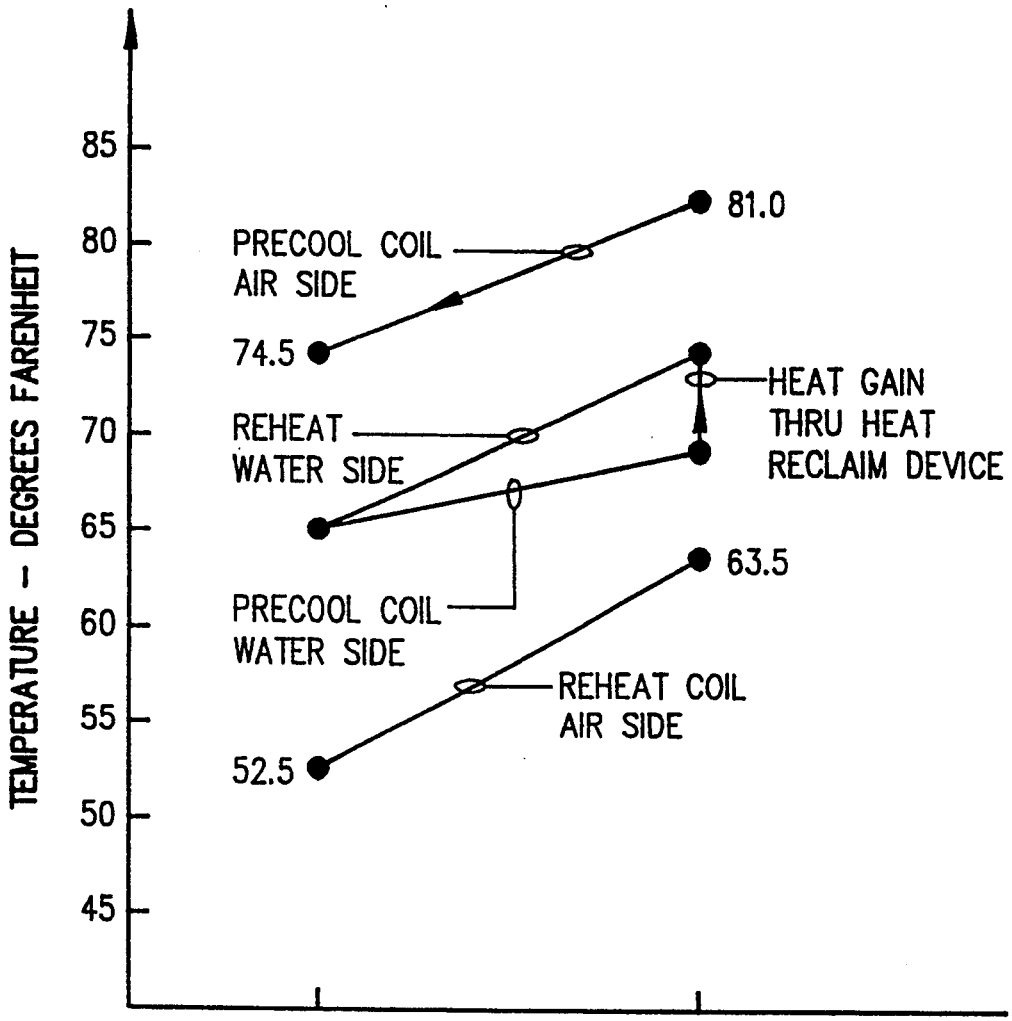
FIG. 10 is a coil graph of a third sample calculation.

The sample calculation C immediately below is illustrated in the coil graph of FIG. 10 and in the psychometric chart of FIGS. 11*a*, 11*b* wherein it is Given that:

Same conditions as Calculation (A), except:
Space sensible cooling load is 110 MBTU/hour
Refrigeration compressor(s) provided with capacity reduction to reduce amount of refrigerant flow, matching the new cooling load; this results in an increased dew point in the supply air.

Statement of Solution:

Assuming capacity reduction raises the supply air dew point to 51° F.; Space condition line intersects dew point line as 65° F. db, this is the supply air dry bulb temperature; space condition line extends up and to the right, establishing a new room condition of 75° F. at ~ 53% relative humidity.

The sample calculation immediately below illustrates the Heating Mode of operation wherein it is Given:

Space heating load is 216000 BTU/Hour, peak;
Supply air volume is 10,000 CFM (from Calculation (A));
Desired space temperature is 72° F.;
Outside air temperature is 35° F.; and,
Outside air volume is 2500 CFM.

Statement of Solution:

Supply air temperature required is $$T_s = \frac{72°\ \text{F.}\ 216000\ \text{BTU/hour}}{1.1 \cdot 10000\ \text{CFM}} = 72°\ \text{F.} + 20 = 92°\ \text{F.}$$

Mixed air temperature is:

$$T_m = 72°\ \text{F.}\left[\frac{216000\ \text{BTU/hour}}{10000\ \text{CFM}} \cdot (72 - 35)\ °\text{F.}\right]$$
$$= 62.75°\ \text{F.}$$

Total heating required $$Q = 1.1 \cdot 10000\ \text{CFM} \cdot (92 - 62.75)\ °\text{F.}$$
$$= 321750\ \text{BTU/hour} = 94\ \text{KW}$$

Heat provided from thermal storage -

-continued

ASSUMPTIONS: full heating shift to OFF peak, 10 hour heating period, 60% diversity.

Heating required:

$$Q = 10 \text{ hours} \cdot 321750 \text{ BTU/hour} \cdot .6 \text{ diversity} = 1930500 \text{ BTU}$$

Heat input to thermal storage:

During moderate temperature periods recovered heat would be used to charge the storage tank. During cold weather, when the cooling system is off, the electric heat would be used to store the energy.

Electric heater size:

$$Q = 1930500 \text{ BTU}/14 \text{ hours} = 137900 \text{ BTU/hour} = 40 \text{ KW*}$$

Thermal storage volume required -

ASSUMPTIONS: minimum useful temperature is 100° F. and storage temperature is 140° F.

$$V = \frac{1930500 \text{ BTU}}{8.35 \text{ lb/gal.} \cdot 1 \text{ BTU/lb} \cdot {}^\circ\text{F.} \cdot (140 - 100)\ {}^\circ\text{F.}}$$

$$V = 5780 \text{ Gallons}$$

The amount of storage could be reduced if the electric heat is allowed to operate during the peak period (at a reduced rate to provide some demand saving):

$$V = \frac{1930500 \text{ BTU} - 10 \text{ hrs} \cdot 20 \text{ KW} \cdot 3413 \text{ BTU/KW}}{8.35 \text{ lb/gal.} \cdot 1 \text{ BTU/lb} \cdot {}^\circ\text{F.} \cdot (140 - 100)\ {}^\circ\text{F.}}$$

$$V = 3736 \text{ Gallons}$$

*Heater size and/or storage volume would be increased slightly to account for system loses.

The invention has been described with reference to the preferred embodiments. Obviously modifications and alterations will occur to others upon a reading and understanding of this specification. It is my intention to include all such modifications and alterations insofar as they come within the scope of the appended claims and equivalents thereof.

Having thus described the invention, I now claim:

1. In an air conditioning system including a cooling coil using a cooling coil fluid to generate a conditioned supply air flow into an air conditioned space downstream of the cooling coil by absorbing thermal energy from a return air flow passing through the cooling coil, the improvement comprising:

first means for introducing thermal energy from the return air flow to a working fluid;

means in said supply air flow for exchanging thermal energy between the working fluid and the supply air flow;

second means for introducing thermal energy into said working fluid from an auxiliary source;

means for directing the working fluid through a series arrangement of said first thermal energy introducing means, said thermal energy exchanging means and said second thermal energy introducing means;

means for motivating a first flow of the working fluid through said directing means; and, control means for sensing moisture in said supply air flow and maintaining said sensed moisture within a predetermined moisture set point range by regulating said first flow of the working fluid.

2. The apparatus according to claim 1 wherein said directing means comprises a fluid conduit means for containedly directing said first flow through said first thermal energy introducing means, said thermal energy exchanging means and said second thermal energy introducing means.

3. The apparatus according to claim 1 wherein said first thermal energy introducing means is a precooling coil in said return air flow and said second thermal energy introducing means is a reheat coil in said supply air flow.

4. The apparatus according to claim 2 wherein said fluid conduit means includes means for containedly directing the first flow successively through said first thermal energy introducing means, said thermal energy exchanging means and then said second thermal energy introducing means.

5. The apparatus according to claim 4 wherein:

said motivating means includes pump means for motivating said first flow through said fluid conduit means responsive to a control signal; and, said control means includes means for sensing temperature in said air conditioned space and generating said control signal when said sensed temperature is outside a predetermined temperature set point range.

6. The apparatus according to claim 5 wherein said pump means comprises a variable speed pump means responsive to said control signal for variably motivating said first flow.

7. The apparatus according to claim 6 wherein said control means includes means for generating said control signal at a first value to decrease said first flow when said sensed temperature is above the predetermined temperature set point range and generating said control signal at a second value to increase said first flow when said sensed temperature is below the predetermined temperature set point range.

8. The apparatus according to claim 7 wherein said control means includes means for generating an analog control signal ranging from said first value to said second value to variably control said variable speed pump means over a continuous pump speed range.

9. The apparatus according to claim 5 further comprising a bypass fluid conduit means connected to said conduit means in parallel with i) said second thermal energy introducing means and ii) said first thermal energy introducing means in series with said thermal energy exchanging means, for containedly directing a bypass flow of said working fluid from said first thermal energy introducing means to said second thermal energy introducing means.

10. The apparatus according to claim 9 further comprising regulating means at said bypass fluid conduit means for regulating said bypass flow of said working fluid responsive to a bypass control signal from said control means.

11. The apparatus according to claim 10 wherein said regulating means comprises a control valve means responsive to said bypass control signal from said control means for variably throttling said bypass flow.

12. The apparatus according to claim 11 wherein said control means includes means for generating said bypass control signal at a first value to decrease said bypass flow when said sensed temperature is below the predetermined temperature set point range and generating said bypass control signal at a second value to increase said bypass flow when said sensed temperature is above the predetermined temperature set point range.

13. The apparatus according to claim 12 wherein said control means includes means for generating an analog bypass control signal ranging from said first value to said second value to variably control said control valve means over a continuous control valve range.

14. The apparatus according to claim 4 wherein:

said motivating means includes pump means for motivating said first flow through said fluid conduit means responsive to a control signal; and, said control means includes means for generating said control signal when said sensed moisture is outside said predetermined moisture set point range.

15. The apparatus according to claim 14 wherein said pump means comprises a variable speed pump means responsive to said control signal for variably motivating said first flow.

16. The apparatus according to claim 15 wherein said control means includes means for generating said control signal at a first value to increase said first flow when the sensed moisture is above the predetermined moisture set point range and generating said control signal at a second value to decrease said first flow when the sensed moisture is below the predetermined moisture set point range.

17. The apparatus according to claim 16 wherein said control means includes means for generating an analog control signal ranging from said first value to said second value to variably control said variable speed pump means over a continuous pump speed range.

18. The apparatus according to claim 14 further comprising a bypass fluid conduit means connected to said conduit means in parallel with i) said second thermal energy introducing means and ii) said first thermal energy introducing means in series with said thermal energy exchanging means, for containedly directing a bypass flow of said working fluid from said first thermal energy introducing means to said second thermal energy introducing means.

19. The apparatus according to claim 18 further comprising regulating means at said bypass fluid conduit means for regulating said bypass flow of said working fluid responsive to a bypass control signal from said control means.

20. The apparatus according to claim 19 wherein said regulating means comprises a control valve means responsive to said bypass control signal from said control means for variably throttling said bypass flow.

21. The apparatus according to claim 20 wherein said control means includes means for generating said bypass control signal at a first value to increase said bypass flow when said sensed moisture is below the predetermined moisture set point range and generating said bypass control signal at a second value to decrease said bypass flow when said sensed moisture is above the predetermined moisture set point range.

22. The apparatus according to claim 21 wherein said control means includes means for generating an analog bypass control signal ranging from said first value to said second value to variably control said control valve means over a continuous control valve range.

23. In an air conditioning system, the combination of:

a cooling coil disposed between an upstream return air flow and a downstream supply air flow;

means for precooling said return air flow;

means for reheating said supply air flow;

means for flowing a working fluid through said precooling means and said reheating means responsive to a first control signal;

means for adding thermal energy to said working fluid responsive to a second control signal; and, control means for sensing a physical property of said supply air flow and generating said first control signal and said second control signal according to the sensed physical property.

24. In an air conditioning system including a cooling coil generating a conditioned supply air flow into an air conditioned space downstream of the cooling coil by absorbing thermal energy from a return air flow received into the cooling coil, the improvement comprising:

first means for introducing thermal energy from the return air flow to a working fluid;

means in said supply air flow for exchanging thermal energy between the working fluid and the supply air flow;

second means for introducing thermal energy into said working fluid from an auxiliary source;

means for directing the working fluid through a series arrangement of said first thermal energy introducing means, said thermal energy exchanging means and said second thermal energy introducing means;

means for motivating a first flow of the working fluid through said directing means; and, control means for sensing a physical property of in said supply air flow and maintaining said sensed physical property below a predetermined set point by regulating said second means for introducing thermal energy into said working fluid.

25. The air conditioning system according to claim 24 wherein said sensed physical property is the temperature of the air conditioned space.

26. The air conditioning system according to claim 24 wherein said sensed physical property is the humidity of the air conditioned space.

27. The air conditioning system according to claim 24 wherein said sensed physical property is the humidity of said supply air flow.

28. The air conditioning system according to claim 24 wherein said sensed physical property is at least one of i) said temperature of the air conditioned space; ii) said humidity of the air conditioned space; and, iii) said humidity of said supply air flow.

29. The air conditioning system according to claim 24 wherein said control means includes means for maintaining said sensed physical property below said predetermined set point by regulating said first flow of the working fluid.

30. The air conditioning system according to claim 29 wherein said sensed physical property is the temperature of the air conditioned space.

31. The air conditioning system according to claim 29 wherein said sensed physical property is the humidity of the air conditioned space.

32. The air conditioning system according to claim 29 wherein said sensed physical property is the humidity of said supply air flow.

33. The air conditioning system according to claim 29 wherein said sensed physical property is at least one of i) said temperature of the air conditioned space; ii) said humidity of the air conditioned space; and, iii) said humidity of said supply air flow.

34. An apparatus for use with an air conditioning system generating a conditioned supply air flow into an air conditioned space downstream of a cooling coil absorbing thermal energy from a return air flow entering the cooling coil, the apparatus comprising:

first means for introducing thermal energy from the return air flow to a working fluid;

means in said supply air flow for exchanging thermal energy between the working fluid and the supply air flow;

second means for introducing thermal energy into said working fluid from an auxiliary source;

means for directing the working fluid through a series arrangement of said first thermal energy introducing means, said thermal energy exchanging means and said second thermal energy introducing means, the directing means comprising a fluid conduit means for containedly directing said first flow through said first thermal energy introducing means, said thermal energy exchanging means and said second thermal energy introducing means, the fluid conduit means including means for containedly directing the first flow successively through said first thermal energy introducing means, said thermal energy exchanging means and then said second thermal energy introducing means;

means for motivating a first flow of the working fluid through said directing means, said motivating means including pump means for motivating said first flow through said fluid conduit means responsive to a control signal; and, control means for sensing moisture in said supply air flow and maintaining said sensed moisture within a predetermined moisture set point range by regulating said first flow of the working fluid said control means including means for sensing temperature in said air conditioned space and generating said control signal when said sensed temperature is outside a predetermined temperature set point range.

35. The apparatus according to claim 34 wherein said pump means comprises a variable speed pump means responsive to said control signal for variably motivating said first flow.

36. The apparatus according to claim 35 wherein said control means includes means for generating said control signal at a first value to decrease said first flow when said sensed temperature is above the predetermined temperature set point range and generating said control signal at a second value to increase said first flow when said sensed temperature is below the predetermined temperature set point range.

37. The apparatus according to claim 36 wherein said control means includes means for generating an analog control signal ranging from said first value to said second value to variably control said variable speed pump means over a continuous pump speed range.

38. The apparatus according to claim 34 further comprising a bypass fluid conduit means connected to said conduit means in parallel with i) said second thermal energy introducing means and ii) said first thermal energy introducing means in series with said thermal energy exchanging means, for containedly directing a bypass flow of said working fluid from said first thermal energy introducing means to said second thermal energy introducing means.

39. The apparatus according to claim 28 further comprising regulating means at said bypass fluid conduit means for regulating said bypass flow of said working fluid responsive to a bypass control signal from said control means.

40. The apparatus according to claim 39 wherein said regulating means comprises a control valve means responsive to said bypass control signal from said control means for variably throttling said bypass flow.

41. The apparatus according to claim 40 wherein said control means includes means for generating said bypass control signal at a first value to decrease said bypass flow when said sensed temperature is below the predetermined temperature set point range and generating said bypass control signal at a second value to increase said bypass flow when said sensed temperature is above the predetermined temperature set point range.

42. The apparatus according to claim 41 wherein said control means includes means for generating an analog bypass control signal ranging from said first value to said second value to variably control said control valve means over a continuous control valve range.

43. An apparatus for use with an air conditioning system generating a conditioned supply air flow into an air conditioned space downstream of a cooling coil absorbing thermal energy from a return air flow entering the cooling coil, the apparatus comprising:

first means for introducing thermal energy from the return air flow to a working fluid;

means in said supply air flow for exchanging thermal energy between the working fluid and the supply air flow;

second means for introducing thermal energy into said working fluid from an auxiliary source;

means for directing the working fluid through a series arrangement of said first thermal energy introducing means, said thermal energy exchanging means and said second thermal energy introducing means, the directing means comprising a fluid conduit means for containedly directing said first flow through said first thermal energy introducing means, said thermal energy exchanging means and said second thermal energy introducing means, said fluid conduit means including means for containedly directing the first flow successively through said first thermal energy introducing means, said thermal energy exchanging means and then said second thermal energy introducing means;

means for motivating a first flow of the working fluid through said directing means, said motivating means including pump means for motivating said first flow through said fluid conduit means responsive to a control signal;

control means for sensing temperature in said air conditioned space and maintaining said sensed temperature within a predetermined temperature set point range by regulating said first flow of the working fluid, said control means including means for generating said control signal when said sensed temperature is outside said predetermined temperature set point range; and, bypass fluid conduit means connected to said conduit means in parallel with i) said second thermal energy introducing means and ii) said first thermal energy introducing means in series with said thermal energy exchanging means, for containedly directing a bypass flow of said working fluid from said first thermal energy introducing means to said second thermal energy introducing means.

44. The apparatus according to claim 43 further comprising regulating means at said bypass fluid conduit means for regulating said bypass flow of said working fluid responsive to a bypass control signal from said control means.

45. The apparatus according to claim 44 wherein said regulating means comprises a control valve means responsive to said bypass control signal from said control means for variably throttling said bypass flow.

46. The apparatus according to claim 45 wherein said control means includes means for generating said bypass control signal at a first value to decrease said bypass flow when said sensed temperature is below the predetermined temperature set point range and generating said bypass control signal at a second value to increase said bypass flow when said sensed temperature is above the predetermined temperature set point range.

47. The apparatus according to claim 46 wherein said control means includes means for generating an analog bypass control signal ranging from said first value to said second value to variably control said control valve means over a continuous control valve range.

48. In an air conditioning system including a cooling coil generating a conditioned supply air flow into an air conditioned space downstream of the cooling coil by absorbing thermal energy from a return air flow received into the cooling coil, the improvement comprising:

first means for introducing thermal energy from the return air flow to a working fluid;

means in said supply air flow for exchanging thermal energy between the working fluid and the supply air flow;

second means for introducing thermal energy into said working fluid from an auxiliary source;

directing means for directing the working fluid through a series arrangement of said first thermal energy introducing means, said thermal energy exchanging means and said second thermal energy introducing means, the directing means including a fluid conduit means for containedly directing a first flow through the first thermal energy introducing means, the thermal energy exchanging means and the second thermal energy introducing means, the fluid conduit means including means for containedly directing the first flow successively through said first thermal energy introducing means, said thermal energy exchanging means and then said second thermal energy introducing means;

motivating means for motivating said first flow of the working fluid through said directing means, the motivating means including pump means for motivating said first flow through said fluid conduit means responsive to a control signal, said pump means comprising a variable speed pump means responsive to said control signal for variably motivating said first flow; and, control means for sensing temperature in said air conditioned space and maintaining said sensed temperature within a predetermined temperature set point range by regulating said first flow of the working fluid, the control means including means for generating said control signal when said sensed temperature is outside said predetermined temperature set point range.

49. The apparatus according to claim 48 wherein said control means includes means for generating said control signal at a first value to decrease said first flow when said sensed temperature is above the predetermined temperature set point range and generating said control signal at a second value to increase said first flow when said sensed temperature is below the predetermined temperature set point range.

50. The apparatus according to claim 49 wherein said control means includes means for generating an analog control signal ranging from said first value to said second value to variably control said variable speed pump means over a continuous pump speed range.

51. In an air conditioning system including a cooling coil generating a conditioned supply air flow into an air conditioned space downstream of the cooling coil by absorbing thermal energy from a return air flow received into the cooling coil, the improvement comprising:

first means for introducing thermal energy from the return air flow to a working fluid;

means in said supply air flow for exchanging thermal energy between the working fluid and the supply air flow;

second means for introducing thermal energy into said working fluid from an auxiliary source;

directing means for directing the working fluid through a series arrangement of said first thermal energy introducing means, said thermal energy exchanging means and said second thermal energy introducing means, the directing means including a fluid conduit means for containedly directing a first flow through the first thermal energy introducing means, the thermal energy exchanging means and the second thermal energy introducing means, the fluid conduit means including means for containedly directing the first flow successively through said first thermal energy introducing means, said thermal energy exchanging means and then said second thermal energy introducing means;

motivating means for motivating said first flow of the working fluid through said directing means, the motivating means including pump means for motivating said first flow through said fluid conduit means responsive to a control signal;

control means for sensing temperature in said air conditioned space and maintaining said sensed temperature within a predetermined temperature set point range by regulating said first flow of the working fluid, the control means including means for generating said control signal when said sensed temperature is outside said predetermined temperature set point range; and, a bypass fluid conduit means connected to said conduit means in parallel with i) said second thermal energy introducing means and ii) said first thermal energy introducing means in series with said thermal energy exchanging means, for containedly directing a bypass flow of said working fluid from said first thermal energy introducing means to said second thermal energy introducing means.

52. The apparatus according to claim 51 further comprising regulating means at said bypass fluid conduit means for regulating said bypass flow of said working fluid responsive to a bypass control signal from said control means.

53. The apparatus according to claim 52 wherein said regulating means comprises a control valve means responsive to said bypass control signal from said control means for variably throttling said bypass flow.

54. The apparatus according to claim 53 wherein said control means includes means for generating said bypass control signal at a first value to decrease said bypass flow when said sensed temperature is below the predetermined temperature set point range and generating said bypass control signal at a second value to increase said bypass flow when said sensed temperature is above the predetermined temperature set point range.

55. The apparatus according to claim 54 wherein said control means includes means for generating an analog bypass control signal ranging from said first value to said second value to variably control said control valve means over a continuous control valve range.

56. A method of air conditioning comprising the steps of:

disposing a cooling coil between an upstream return air flow and a downstream supply air flow;

precooling said return air flow using a precooling device;

reheating said supply air flow using a reheating device;

communicating a flow of a working fluid through said precooling device and said reheating device;

injecting thermal energy into said working fluid responsive to a control signal; and, sensing a physical property of said supply air flow and generating said control signal according to the sensed physical property.

57. A method of air conditioning comprising the steps of:

disposing a cooling coil between an upstream return air flow and a downstream supply air flow;

precooling said return air flow with a precooling coil;

reheating said supply air flow with a reheating coil;

flowing a working fluid through said precooling coil and said reheating coil responsive to a first control signal;

adding thermal energy to said working fluid responsive to a second control signal; and, sensing a physical property of said supply air flow and generating said first control signal and said second control signal according to the sensed physical property.

58. In an air conditioning system, the combination of:

a cooling coil disposed between an upstream return air flow and a downstream supply air flow;

means for precooling said return air flow;

means for reheating said supply air flow;

means for communicating a flow of a working fluid through said precooling means and said reheating means;

means for injecting thermal energy into said working fluid responsive to a control signal; and, control means for sensing a physical property of said supply air flow and generating said control signal according to the sensed physical property.

59. An apparatus for use with an air conditioning system generating a conditioned supply air flow into an air conditioned space downstream of a cooling coil absorbing thermal energy from a return air flow entering the cooling coil, the apparatus comprising:

first means for introducing thermal energy from the return air flow to a working fluid;

means in said supply air flow for exchanging thermal energy between the working fluid and the supply air flow;

second means for introducing thermal energy into said working fluid from an auxiliary source;

means for directing the working fluid through a series arrangement of said first thermal energy introducing means, said thermal energy exchanging means and said second thermal energy introducing means, the directing means comprising a fluid conduit means for containedly directing said first flow through said first thermal energy introducing means, said thermal energy exchanging means and said second thermal energy introducing means, the fluid conduit means including means for containedly directing the first flow successively through said first thermal energy introducing means, said thermal energy exchanging means and then said second thermal energy introducing means;

means for motivating a first flow of the working fluid through said directing means, the motivating means including pump means for motivating said first flow through said fluid conduit means responsive to a control signal;

control means for sensing moisture in said supply air flow and maintaining said sensed moisture within a predetermined moisture set point range by regulating said first flow of the working fluid, said control means including means for generating said control signal when said sensed moisture is outside said predetermined moisture set point range; and, bypass fluid conduit means connected to said conduit means in parallel with i) said second thermal energy introducing means and ii) said first thermal energy introducing means in series with said thermal energy exchanging means, for containedly directing a bypass flow of said working fluid from said first thermal energy introducing means to said second thermal energy introducing means.

60. The apparatus according to claim 59 further comprising regulating means at said bypass fluid conduit means for regulating said bypass flow of said working fluid responsive to a bypass control signal from said control means.

61. The apparatus according to claim 60 wherein said regulating means comprises a control valve means responsive to said bypass control signal from said control means for variably throttling said bypass flow.

62. The apparatus according to claim 61 wherein said control means includes means for generating said bypass control signal at a first value to increase said bypass flow when said sensed moisture is below the predetermined moisture set point range and generating said bypass control signal at a second value to decrease said bypass flow when said sensed moisture is above the predetermined moisture set point range.

63. The apparatus according to claim 62 wherein said control means includes means for generating an analog bypass control signal ranging from said first value to said second value to variably control said control valve means over a continuous control valve range.

* * * * *